US008944248B2

(12) United States Patent
Jones et al.

(10) Patent No.: US 8,944,248 B2
(45) Date of Patent: Feb. 3, 2015

(54) BLANK CONFIGURED TO FORM A PACKAGE AND RELATED PACKAGE AND METHOD

(71) Applicant: R.J. Reynolds Tobacco Company, Winston-Salem, NC (US)

(72) Inventors: Wesley Steven Jones, Lexington, NC (US); Jerry Wayne Pipes, Clemmons, NC (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 0 days.

(21) Appl. No.: 13/798,779

(22) Filed: Mar. 13, 2013

(65) Prior Publication Data

US 2014/0263596 A1 Sep. 18, 2014

(51) Int. Cl.

| | |
|---|---|
| ***B65D 5/42*** | (2006.01) |
| ***B31B 1/26*** | (2006.01) |
| ***B31B 1/74*** | (2006.01) |
| ***B65D 5/66*** | (2006.01) |

(52) U.S. Cl.

CPC ..... *B65D 5/4204* (2013.01); *B31B 1/26* (2013.01); *B31B 1/74* (2013.01); *B65D 5/66* (2013.01)

USPC ..... 206/446; 206/463

(58) Field of Classification Search

USPC ..... 206/446, 418, 419, 583, 443, 273, 271, 206/242, 148, 463; 229/121, 131

See application file for complete search history.

(56) References Cited

U.S. PATENT DOCUMENTS

| | | | | | |
|---|---|---|---|---|---|
| D47,574 | S | | 7/1915 | Warren | |
| 1,932,804 | A | * | 10/1933 | Risk | 229/120.16 |
| 2,128,197 | A | * | 8/1938 | Weil | 206/777 |
| 3,059,830 | A | * | 10/1962 | Kramer | 206/418 |
| 3,182,885 | A | * | 5/1965 | Maio | 206/455 |
| 3,547,256 | A | * | 12/1970 | Bolding | 206/418 |
| 3,695,422 | A | | 10/1972 | Tripodi | |
| 3,874,581 | A | | 4/1975 | Fox et al. | |
| 3,944,066 | A | | 3/1976 | Niepmann | |
| 3,968,924 | A | * | 7/1976 | Tyrseck | 206/418 |
| RE29,263 | E | * | 6/1977 | Roccaforte | 206/418 |
| 4,181,220 | A | * | 1/1980 | Zicko | 206/315.2 |
| 4,498,580 | A | * | 2/1985 | Getz et al. | 206/418 |
| 4,717,017 | A | | 1/1988 | Sprinkel, Jr. et al. | |
| 4,852,734 | A | | 8/1989 | Allen et al. | |
| 5,000,374 | A | | 3/1991 | Deiger | |

(Continued)

OTHER PUBLICATIONS

U.S. Appl. No. 29/432,110, Sep. 13, 2012, Potter.

(Continued)

*Primary Examiner* — Steven A. Reynolds
(74) *Attorney, Agent, or Firm* — Womble Carlyle Sandridge & Rice, LLP

(57) ABSTRACT

A blank configured to form a package is provided. The blank may include a cover panel, a back panel, a top panel, and an elevating panel. The elevating panel and the back panel may cooperate to form a compartment when formed into a package. The top panel may include apertures that align with aligning apertures in the elevating panel. The cover panel may be pivoted between a closed configuration in which the apertures are covered and an open configuration in which the apertures are uncovered. Accordingly, a user may view the contents of the compartment when the cover panel is in the open configuration. The compartment may be employed to store cartridges for an aerosol delivery device. A related method for forming the blank into the package is also provided.

15 Claims, 21 Drawing Sheets

(56) References Cited

U.S. PATENT DOCUMENTS

| | | | | |
|---|---|---|---|---|
| D318,802 | S | 8/1991 | Egide | |
| 5,121,838 | A * | 6/1992 | Dickie | 206/454 |
| 5,333,729 | A | 8/1994 | Wolfe | |
| 5,542,539 | A | 8/1996 | Early | |
| D389,739 | S | 1/1998 | Auclair | |
| 5,871,145 | A * | 2/1999 | Hermann et al. | 229/120.21 |
| D427,522 | S | 7/2000 | Ponzio | |
| D432,418 | S | 10/2000 | Saulas | |
| D432,912 | S | 10/2000 | Lubineau-Bigot et al. | |
| D439,840 | S | 4/2001 | Saulas | |
| 7,028,839 | B2 * | 4/2006 | Belloli et al. | 206/443 |
| 7,367,455 | B2 * | 5/2008 | Maffei | 206/528 |
| 7,617,930 | B2 | 11/2009 | Jones et al. | |
| D643,747 | S | 8/2011 | Rye et al. | |
| D686,065 | S | 7/2013 | Kuo et al. | |
| 2003/0217946 | A1 | 11/2003 | Hsu | |
| 2005/0150788 | A1 | 7/2005 | Feusner | |
| 2010/0065620 | A1 | 3/2010 | Smith | |

OTHER PUBLICATIONS

U.S. Appl. No. 29/447,898, Mar. 7, 2013, Burdock-Latter.
U.S. Appl. No. 29/448,549, Mar. 13, 2013, Jones.
U.S. Appl. No. 13/524,218, Jun. 15, 2012, Coatney.

* cited by examiner

BLANK CONFIGURED TO FORM A PACKAGE AND RELATED PACKAGE AND METHOD

FIELD OF THE DISCLOSURE

The present disclosure relates to a blank configured to form a package, and more particularly to a blank configured to form a package and a related package and method. The package may be employed to hold one or more cartridges for an aerosol delivery device. The aerosol delivery device may be configured to heat an aerosol precursor in the cartridge, which may be made or derived from tobacco or otherwise incorporate tobacco, to form an inhalable substance for human consumption.

BACKGROUND

Popular smoking articles, such as cigarettes, conventionally have been sold in packages. Typically, each full package contains about 20 cigarettes. Cigarettes have been packaged in containers known as so-called "soft packs." See, for example, U.S. Pat. No. 3,695,422 to Tripodi; U.S. Pat. No. 4,717,017 to Sprinkel, Jr., et al.; and U.S. Pat. No. 5,333,729 to Wolfe, all of which are incorporated herein by reference. Cigarettes also have been packaged in containers known as so-called "hard packs" or "crush proof boxes." See, for example, U.S. Pat. No. 3,874,581 to Fox et al.; U.S. Pat. No. 3,944,066 to Niepmann; and U.S. Pat. No. 4,852,734 to Allen et al., all of which are incorporated herein by reference.

However, many smoking devices have been proposed through the years as improvements upon, or alternatives to, smoking products that require combusting tobacco for use. Many of those devices purportedly have been designed to provide the sensations associated with cigarette, cigar, or pipe smoking, but without delivering considerable quantities of incomplete combustion and pyrolysis products that result from the burning of tobacco. To this end, there have been proposed numerous smoking products, flavor generators, and medicinal inhalers that utilize electrical energy to vaporize or heat a volatile material, or attempt to provide the sensations of cigarette, cigar, or pipe smoking without burning tobacco to a significant degree. See, for example, the various alternative smoking articles, aerosol delivery devices and heat generating sources set forth in the background art described in U.S. Pat. No. 7,726,320 to Robinson et al., U.S. patent application Ser. No. 13/432,406, filed Mar. 28, 2012, U.S. patent application Ser. No. 13/536,438, filed Jun. 28, 2012, U.S. patent application Ser. No. 13/602,871, filed Sep. 4, 2012, and U.S. patent application Ser. No. 13/647,000, filed Oct. 8, 2012, which are incorporated herein by reference.

Some embodiments of aerosol cartridges may employ cartridges to store an aerosol precursor useable in conjunction with a control body of an aerosol delivery device to form aerosol and simulate smoking, as described above. The cartridges or other containers useable in conjunction with an aerosol delivery device may differ in size or shape from traditional smoking articles. Accordingly, it would be desirable to provide a blank, package and related method for packaging one or more cartridges for an aerosol delivery device or other product.

SUMMARY OF THE DISCLOSURE

In one aspect a blank configured to form a package is provided. The blank may comprise a cover panel, a bottom panel coupled to the cover panel, a top panel coupled to the bottom panel, and an elevating panel coupled to the top panel. The top panel may include one or more apertures. The elevating panel may include a first side panel, a second side panel, and a center panel positioned between the first side panel and the second side panel and defining one or more aligning apertures extending therethrough and configured to overlap and align with the one or more apertures of the top panel.

In some embodiments the blank may further comprise a plurality of connecting panels, wherein a respective one of the connecting panels is positioned between the cover panel and the bottom panel, between the bottom panel and the top panel, and between the top panel and the elevating panel. The blank may further comprise a first plurality of end panels coupled to the bottom panel and a second plurality of end panels coupled to the top panel, wherein the first plurality of end panels are configured to overlap with the second plurality of end panels. The elevating panel may comprise a plurality of cuts extending therethrough between the first side panel and the center panel and between the second side panel and the center panel. Each of the cuts may define an arc and a concave side of the arc may be oriented toward the one or more aligning apertures. The elevating panel may further comprise a first engagement panel and a second engagement panel, wherein the first side panel is positioned between the first engagement panel and the one or more aligning apertures and the second side panel is positioned between the second engagement panel and the one or more aligning apertures.

In an additional aspect a package is provided. The package may comprise a cover panel, a bottom panel coupled to the cover panel, a top panel coupled to the bottom panel, and an elevating panel coupled to the top panel. The top panel may include one or more apertures. The elevating panel may include a first side panel, a second side panel, and a center panel positioned between the first side panel and the second side panel and defining one or more aligning apertures extending therethrough. The first side panel and the second side panel may extend between the bottom panel and the elevating panel and position the center panel in contact with, and substantially parallel to, the top panel such that the one or more aligning apertures of the elevating panel overlap and align with the one or more apertures of the top panel and a compartment is defined by the elevating panel and the bottom panel.

In some embodiments the package may further include a plurality of connecting panels, wherein a respective one of the connecting panels is positioned between the cover panel and the bottom panel, between the bottom panel and the top panel, and between the top panel and the elevating panel. The package may additionally include a first plurality of end panels coupled to the bottom panel and a second plurality of end panels coupled to the top panel, wherein the first plurality of end panels overlap with the second plurality of end panels. The package may further include an attachment mechanism coupled to one or both of the cover panel and the top panel and configured to releasably couple the cover panel to the top panel.

In some embodiments the elevating panel may include a plurality of cuts extending therethrough between the first side panel and the center panel and between the second side panel and the center panel. Each of the cuts may define an arc and a concave side of the arc may be oriented toward the one or more aligning apertures. The elevating panel may additionally include a first engagement panel and a second engagement panel respectively engaged with the bottom panel. The first side panel may be positioned between the first engagement panel and the one or more aligning apertures and the second side panel may be positioned between the second engagement panel and the one or more aligning apertures. The cover may be hingedly coupled to the bottom panel and configured to move between a closed configuration in which the cover covers the one or more apertures of the top panel and an open configuration in which the one or more apertures of the top panel are uncovered.

In a further aspect a method for forming a package is provided. The method may include providing a blank defining a first side and a second side. The blank may include a cover panel, a bottom panel coupled to the cover panel, a top panel coupled to the bottom panel, and an elevating panel coupled to the top panel. The top panel may include one or more apertures. The elevating panel may include a first side panel, a second side panel, and a center panel positioned between the first side panel and the second side panel and defining one or more aligning apertures extending therethrough and configured to overlap and align with the one or more apertures of the top panel. The method may also include coupling the elevating panel to the bottom panel.

In some embodiments the method may further include coupling the center panel of the elevating panel to the top panel. The elevating panel may additionally include a first engagement panel and a second engagement panel. The first side panel may be positioned between the first engagement panel and the one or more aligning apertures and the second side panel may be positioned between the second engagement panel and the one or more aligning apertures. Coupling the elevating panel to the bottom panel may include coupling the first engagement panel and the second engagement panel to the bottom panel.

In some embodiments the method may also include folding the blank between the second side panel and the center panel toward the first side, folding the blank between the elevating panel and the top panel toward the second side, and folding the blank between the top panel and the bottom panel toward the second side. The method may additionally include coupling an attachment mechanism to one or both of the cover panel and the top panel and folding the blank between the bottom panel and the cover panel toward the second side. The blank may further include a first plurality of end panels coupled to the bottom panel and a second plurality of end panels coupled to the top panel. The method may additionally include folding the first plurality of end panels relative to the bottom panel toward the second side, folding the second plurality of end panels relative to the top panel toward the second side, and coupling the first plurality of end panels to the second plurality of end panels.

Other aspects and advantages of the present disclosure are apparent from the following.

BRIEF DESCRIPTION OF THE DRAWINGS

In order to assist the understanding of embodiments of the disclosure, reference will now be made to the appended drawings, which are not necessarily drawn to scale. The drawings are exemplary only, and should not be construed as limiting the disclosure.

DETAILED DESCRIPTION OF THE PREFERRED EMBODIMENTS

The present disclosure now will be described more fully hereinafter with reference to the accompanying drawings. The disclosure may be embodied in many different forms and should not be construed as limited to the embodiments set forth herein; rather, these embodiments are provided so that this disclosure will satisfy applicable legal requirements. Like numbers refer to like elements throughout. As used in this specification and the claims, the singular forms "a," "an," and "the" include plural references unless the context clearly dictates otherwise.

Figure 1:
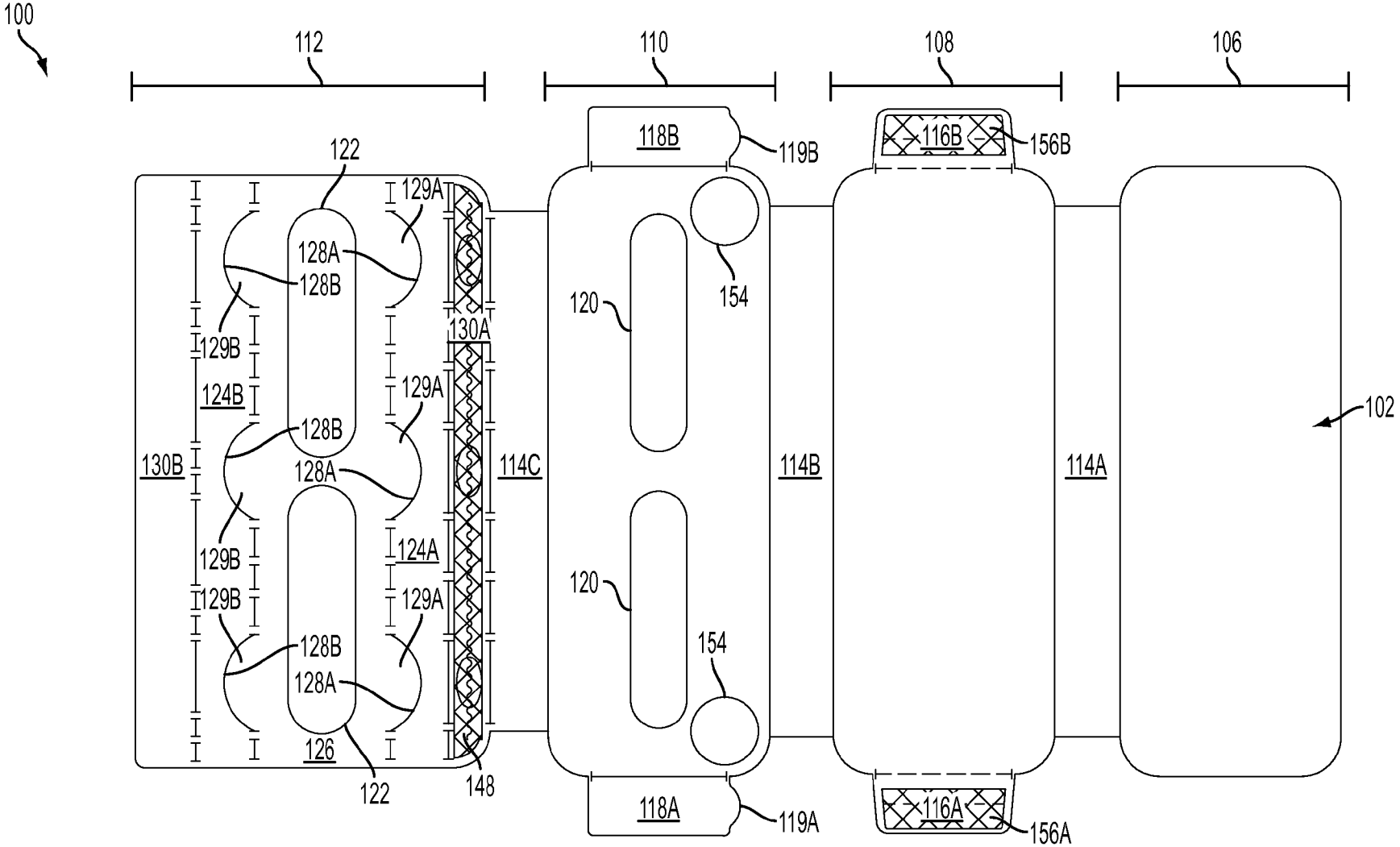
FIG. 1 is a plan view of a first side of a blank configured to form a package according to an example embodiment of the present disclosure.
Figure 2:
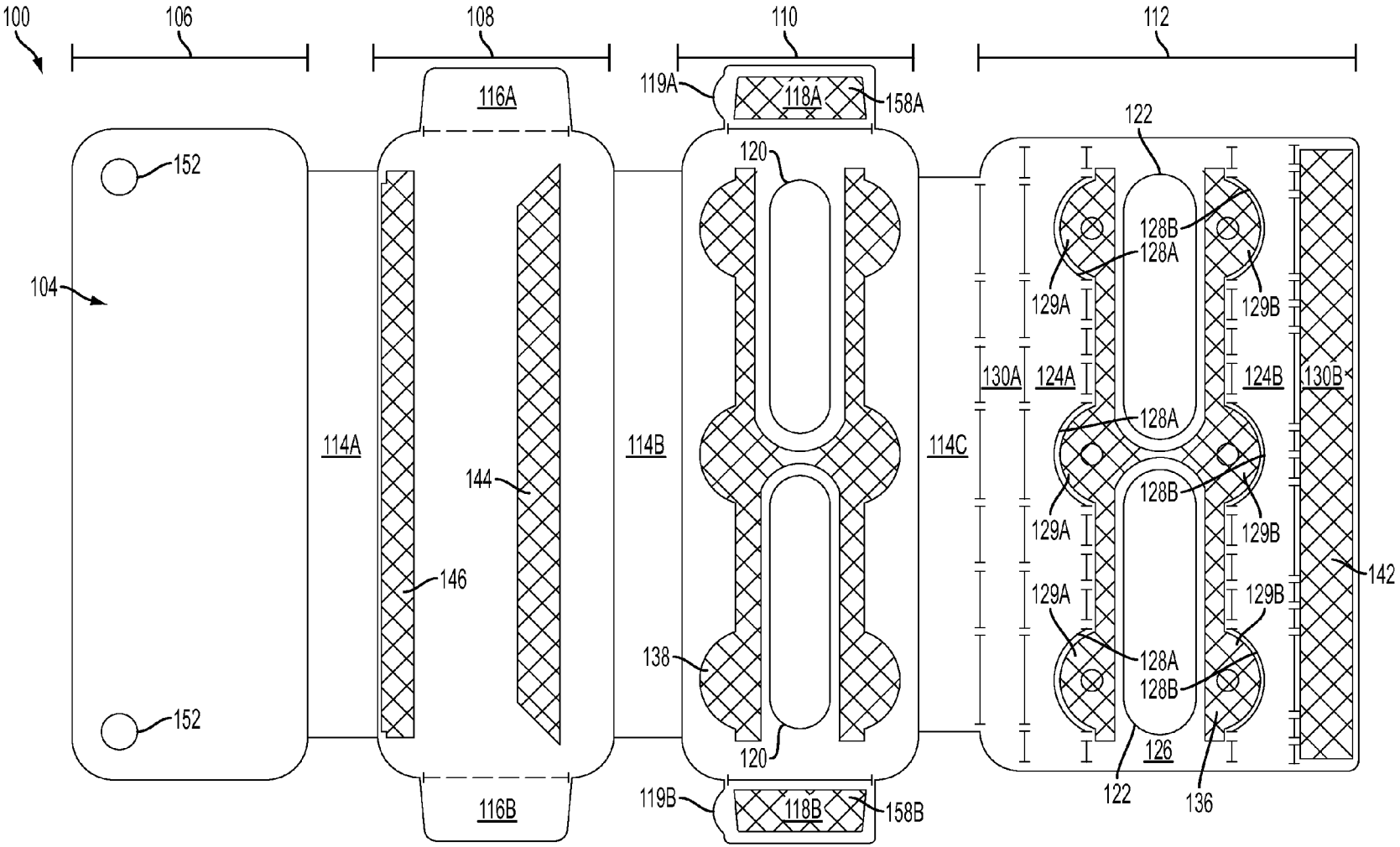
FIG. 2 is a plan view of a second opposing side of the blank of FIG. 1.

As described herein, embodiments of the disclosure relate to blanks configured to form a package and related packages and methods. In this regard, FIG. 1 illustrates a plan view of a first side 102 of an example embodiment of a blank 100 configured to form a package. FIG. 2 illustrates a plan view of an opposing second side 104 of the blank.

The blank 100 may comprise one or more layers of one or more materials suitable to provide structure to the blank such that it may form a package as described below. For example, the blank 100 may comprise paper, paperboard, cardboard, thermoplastic, or any other suitable material. In some embodiments the material defining the blank 100 may be laminated or coated with wax or other material. Further, the blank 100 may be imprinted via any of various known methods to provide the blank with, for example, an ornamental design, and/or identifying information. Useful exemplary materials include paperboard of a suitable type and stock, such as 10 to 14 point SBS paper board (i.e., solid bleached sulfate paper), which may include a coating on one or both sides, such as a clay coating. Comparable board containing post consumer recycled content likewise may be used. Suitable paper stock can be obtained commercially, such as from International Paper or MeadWestvaco.

The blank 100 may define various embodiments of sizes and shapes. Accordingly, it should be understood that the embodiment of the illustrated blank 100 is provided for example purposes only. In this regard, as illustrated, the blank 100 may comprise a cover panel 106, a bottom panel 108, a top panel 110, and an elevating panel 112. The bottom panel 108 may be coupled to the cover panel 106, the top panel 110 may be coupled to the bottom panel 108, and the elevating panel 112 may be coupled to the top panel 110. For example, the blank 100 may comprise a first connecting panel 114A, a second connecting panel 114B, and a third connecting panel 114C (collectively, "connecting panels 114"). The first connecting panel 114A may be positioned between the cover panel 106 and the bottom panel 108, the second connecting panel 114B may be positioned between the bottom panel 108 and the top panel 110, and the third connecting panel 114C may be positioned between the top panel 110 and the elevating panel 112.

Further, the blank 100 may comprise a first plurality of end panels 116A,B (collectively, "first end panels 116") coupled to the bottom panel 108. Similarly, the top panel 110 may include a second plurality of end panels 118A,B (collectively, "second end panels 118"). As described below, the first end panels 116 may be configured to overlap with the second end panels 118 when the blank 100 is formed into a package.

In some embodiments, as illustrated, the second end panels 118 may define a greater longitudinal length than the first end panels 116. In this regard, the second end panels 118 are illustrated as respectively including an extension 119A, B that is configured to extend past the end of the first end panels 116 when the first end panels and the second end panels overlap. Accordingly, the extensions 119A, B may be grasped by a user and employed to release a coupling between the first end panels 116 and the second end panels 118 to open the package formed from the blank 100.

Additionally, in some embodiments the top panel 110 may comprise one or more apertures 120 extending therethrough. Similarly, the elevating panel 112 may comprise may comprise one or more aligning apertures 122 extending therethrough. The aligning apertures 122 of the elevating panel 112 may be configured to overlap and align with the apertures 120 of the top panel 110 such that a user may view therethrough in the completed package.

The elevating panel 112 may comprise a first side panel 124A and a second side panel 124B (collectively, "side panels 124"). Further, the elevating panel 112 may include a center panel 126 positioned between the side panels 124, and the one or more aligning apertures 122 may extend therethrough. In some embodiments the elevating panel 112 may comprise a first plurality of cuts 128A extending therethrough between the first side panel 124A and the center panel 126 and a second plurality of cuts 128B extending therethrough between the second side panel 124B and the center panel. Each of the first plurality of cuts 128A and the second plurality of cuts 128B (collectively, "cuts 128") may define an arc shape. A concave side of each arc-shaped cut 128 may be oriented toward the one or more aligning apertures 122. Thus, a first plurality of tabs 129A and a second plurality of tabs 129B (collectively, "tabs 129") may be formed by the cuts 128 at the center panel 126, which may match the arc shape thereof.

Additionally, the elevating panel 112 may comprise a first engagement panel 130A and a second engagement panel 130B (collectively, "engagement panels 130"). The first side panel 124A may be positioned between the first engagement panel 130A and the aligning apertures 122 extending through the center panel 126. Further, the second side panel 124B may be positioned between the second engagement panel 130B and the aligning apertures 122 extending through the center panel 126. As discussed below, the engagement panels 130 may be configured to couple to the bottom panel 108 in the assembled package formed from the blank.

Figure 3:
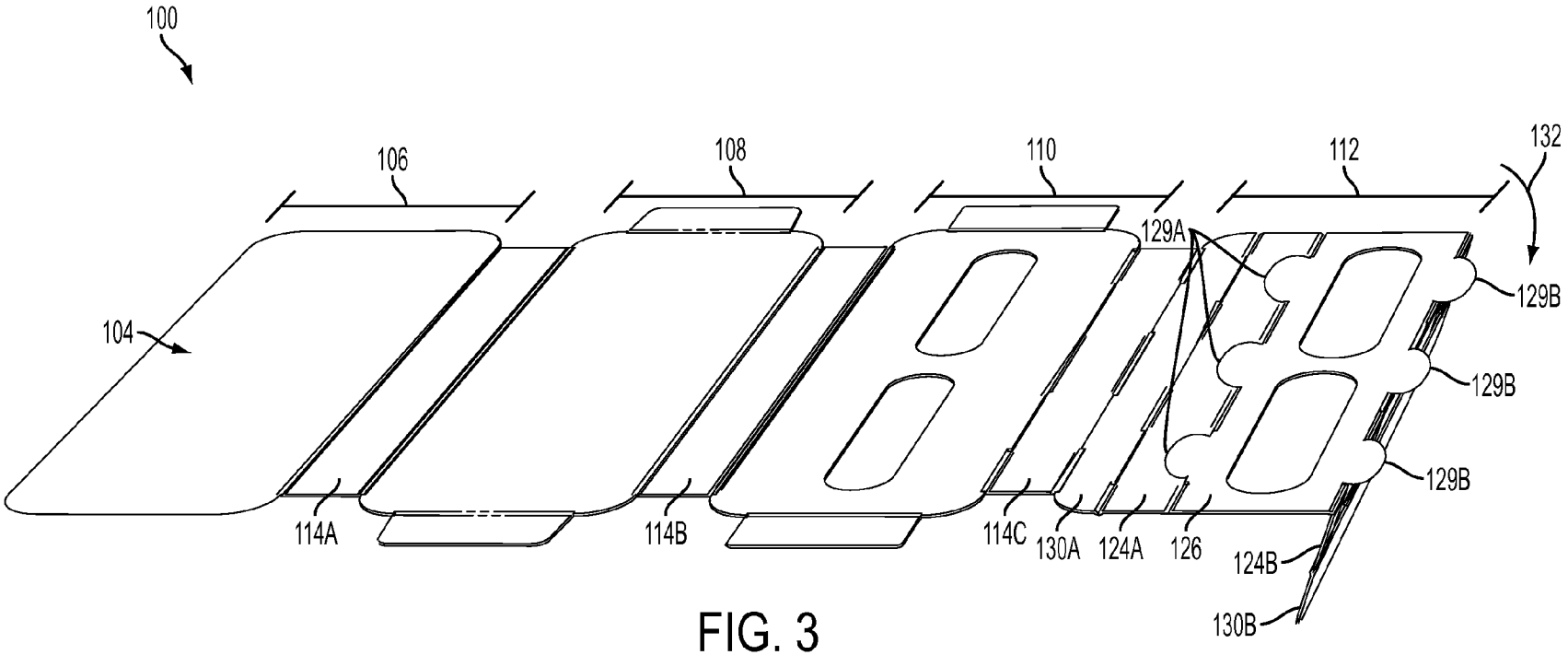
FIG. 3 is a perspective view of a first step employed to form the blank of FIG. 1 into a package.

As mentioned above, the blank 100 may be formed into a package. In this regard, FIGS. 3-6 illustrate operations performed in forming the blank 100 into a package from the initial flat configuration illustrated in FIG. 2. FIG. 3 illustrates folding the blank 100 at the elevating panel 112 between the center panel 126 and the second side panel 124B. More particularly, the second side panel 124B is folded toward the first side 102 of the blank 100 in a substantially clockwise direction, in terms of the orientation illustrated in FIG. 3, as indicated by arrow 132. Although the second side panel 124B and the second fixation panel 130B may be folded into contact with the center panel 126, these panels may not be affixed to one another.

Figure 4:
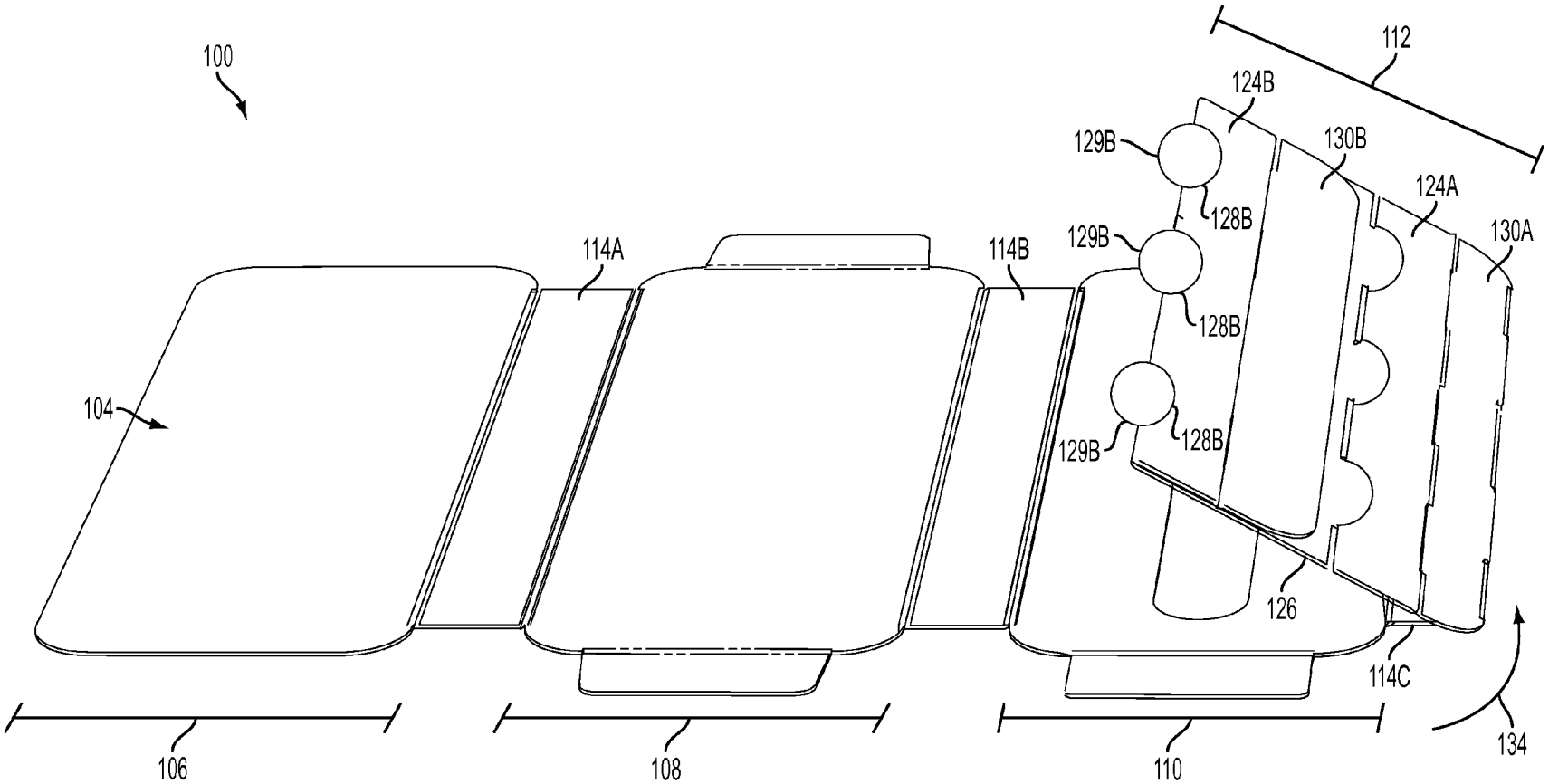
FIG. 4 is a perspective view of a second step employed to form the blank of FIG. 1 into a package.

As illustrated in FIG. 4, the blank 100 may also be folded between the elevating panel 112 and the top panel 110. More particularly, the blank 100 may be folded between the elevating panel 112 and the third connecting panel 114C. The elevating panel 112 may be folded toward the second side 104 of the blank 100 in a substantially counterclockwise direction, in terms of the orientation illustrated in FIG. 4, as indicated by arrow 134.

The second side 104 of the elevating panel 112 may be coupled to the second side of the top panel 110 during the folding movement illustrated in FIG. 4 via an adhesive or other bonding mechanism such as via a heat weld. Exemplary types of adhesives that may be used include vinyl acetates, hot melts, and dextrins, including adhesives such as those available from Henkel AG & Co. As illustrated in FIG. 2, an adhesive may be placed on the second side 104 of the elevating panel 112 at an adhesive area 136 on the center panel 126 and/or at an adhesive area 138 on the second side of the top panel 110. As illustrated, the one or more adhesive areas 136, 138 may be sized and shaped such that only the center panel 126 of the elevating panel 112, as opposed to the surrounding portions of the blank 100, is coupled to the top panel 110 during the folding movement illustrated in FIG. 4.

Figure 5:
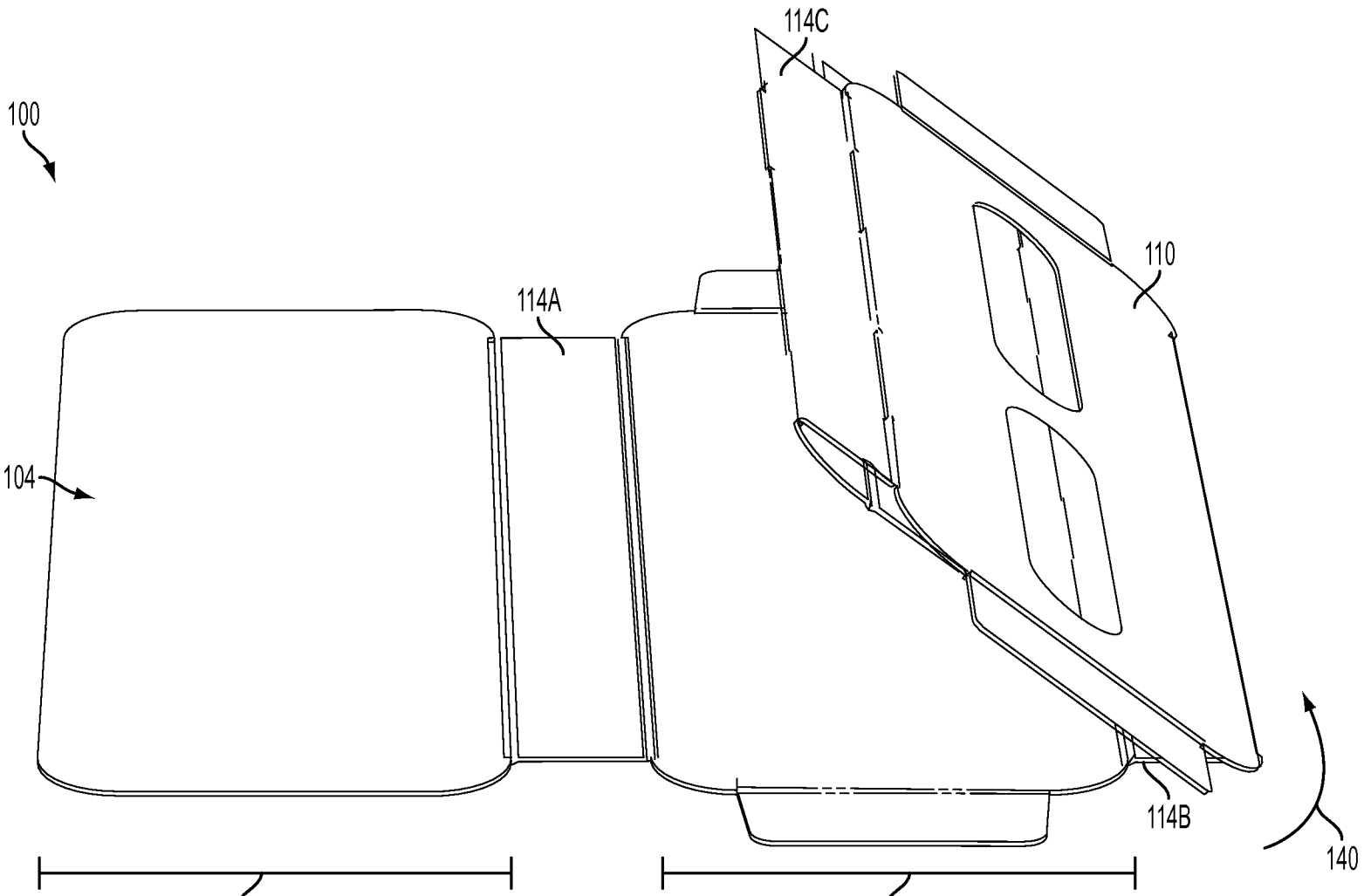
FIG. 5 is a perspective view of a third step employed to form the blank of FIG. 1 into a package.

The blank 100 may also be folded between the top panel 110 and the bottom panel 108, as illustrated in FIG. 5. More particularly, the blank 100 may be folded between the top panel 110 and the second connecting panel 114B. The top panel 110 may be folded toward the second side 104 of the blank in a substantially counterclockwise direction, in terms of the orientation illustrated in FIG. 5, as illustrated by arrow 140.

Both the first side 102 and the second side 104 of the elevating panel 112 may be coupled to the second side of the bottom panel 108 during the folding movement illustrated in FIG. 5. The coupling may be implemented via an adhesive as described above or other bonding mechanism such as via a heat weld. In this regard, as illustrated in FIG. 2, an adhesive may be placed on the second side 104 of the second engagement panel 130B at an adhesive area 142 and/or at an adhesive area 144 on the second side of the bottom panel 108. Further, an adhesive may be placed at an adhesive area 146 on the second side 104 of the bottom panel 108 and/or at an adhesive area 148 on the first side 102 of the first engagement panel 130A. As illustrated, a first set of the adhesive areas 142, 144 may be sized and shaped such that only the second engagement panel 130B of the elevating panel 112, as opposed to the surrounding portions of the blank 100, is coupled to the bottom panel 108 during the folding movement illustrated in FIG. 5. Further, a second set of the adhesive areas 146, 148 may be sized and shaped such that only the first engagement panel 130A of the elevating panel 112, as opposed to the surrounding portions of the blank 100, is coupled to the bottom panel 108 during the folding movement illustrated in FIG. 5.

Figure 6:
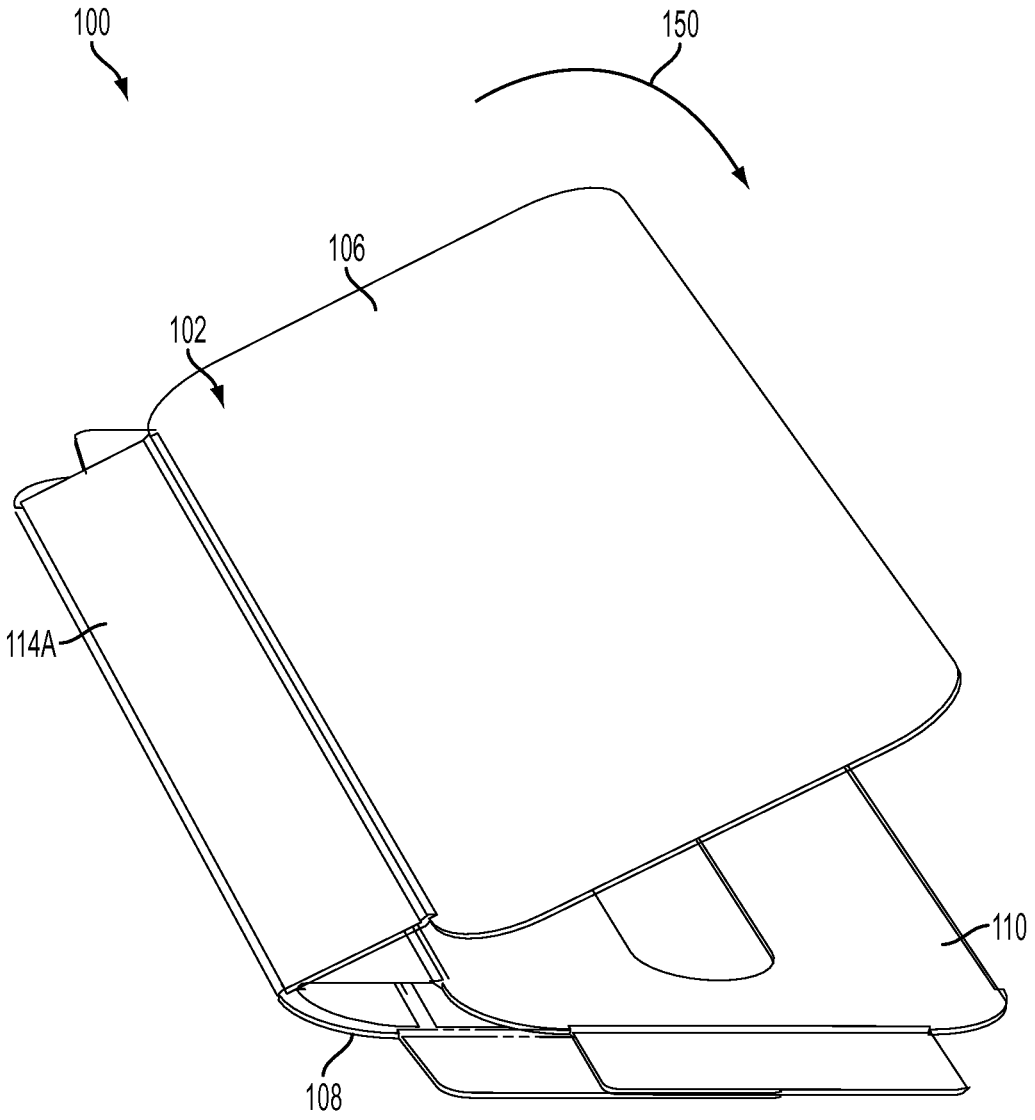
FIG. 6 is a perspective view of a fourth step employed to form the blank of FIG. 1 into a package.

The blank 100 may also be folded between the bottom panel 108 and the cover panel 106, as illustrated in FIG. 6. More particularly, the blank 110 may be folded between the bottom panel 108 and the first connecting panel 114A. The cover panel 106 may be folded toward the second side 104 of the blank 100 in a substantially clockwise direction, in terms of the orientation illustrated in FIG. 6, as indicated by arrow 150.

The second side 104 of the cover panel 106 may be releasably coupled to the first side 102 of the top panel 110 during the folding movement illustrated in FIG. 6. Whereas the above-described coupling arrangements employ an adhesive or bonding mechanism that is configured to be substantially permanent, coupling between the cover panel 106 and the top panel 110 may be configured to be releasable. Accordingly, by way of example, formation of the blank 100 into a package may include coupling an attachment mechanism to one or both of the cover panel 106 and the top panel 110 prior to folding the blank 100 as illustrated in FIG. 6.

In one embodiment the attachment mechanism may comprise a hot melt adhesive, which may be coupled to the second side 104 of the cover panel 106 as illustrated in FIG. 2 at adhesive areas 152. Further, the first side 102 of the top panel 110 may include attachment areas 154 to which the hot melt adhesive releasably couples, as illustrated in FIG. 1. The attachment areas 154 may include varnish-free ink waxes or other mechanisms configured to facilitate releasable coupling of the hot melt adhesive at the attachment areas 154. However, in alternate embodiments the attachment areas may be positioned on the cover panel 106 and the adhesive areas may be positioned on the top panel 110. Further, various other embodiments of attachment mechanisms may be employed such as hook and loop fasteners, snap buttons, or interference fit arrangements wherein all or a portion of the cover panel is inserted into a slot in the top panel or other portion of the blank.

Figure 7:
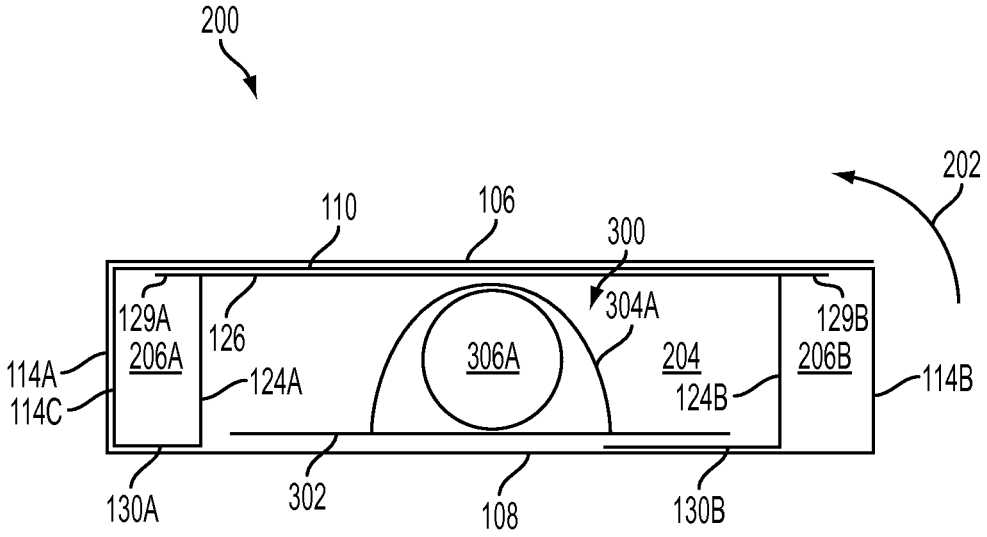
FIG. 7 is a left side view of a package formed from the blank of FIG. 1 and including a product received therein according to an example embodiment of the present disclosure.

Accordingly, as illustrated in FIG. 7, a package 200 may be formed by the above-described operations. FIG. 7 illustrates a left side view of the package 200. The package 200 may initially define a substantially flat configuration when produced by the above-described folding operations. Thus, all of the package 200 may be shifted perpendicularly and vertically in an unfolding motion relative to the bottom panel 108 as indicated by arrow 202 to define the three-dimensional shape illustrated in FIG. 7.

As illustrated, the package 200 may define a main compartment 204 and a first side compartment 206A and a second side compartment 206B (collectively, "side compartments 206") on opposing sides thereof. The main compartment 204 may be defined by the elevating panel 112, the bottom panel 108, and the end panels 116, 118. More particularly, the bottom panel 108 and the second engagement panel 130B may define a bottom of the main compartment 204. The side panels 124 may define the sides of the main compartment 204. The center panel 126 may define the top of the main compartment 204.

The bottom of the first side compartment 206A may be defined by the first engagement panel 130A. The sides of the first side compartment 206A may be defined by the first side panel 124A and the third connecting panel 114C. The top of the first side compartment 206A may be defined by the top panel 110 and the first plurality of tabs 129A.

The bottom of the second side compartment 206B may be defined by the bottom panel 108. The sides of the second side compartment 206B may be defined by the second side panel 124B and the second connecting panel 114B. The top of the second side compartment 206B may be defined by the top panel 110 and the second plurality of tabs 129B.

As further illustrated in FIG. 7, a product 300 may be received in the main compartment 204. Various embodiments of products may be received therein. However, in the illustrated embodiment the product 300 comprises a blister pack including a backing 302 and a bubble 304A with a cartridge 306A for an aerosol delivery device received therein. However, various other embodiments of products may be received in the main compartment in other embodiments.

Figure 8:
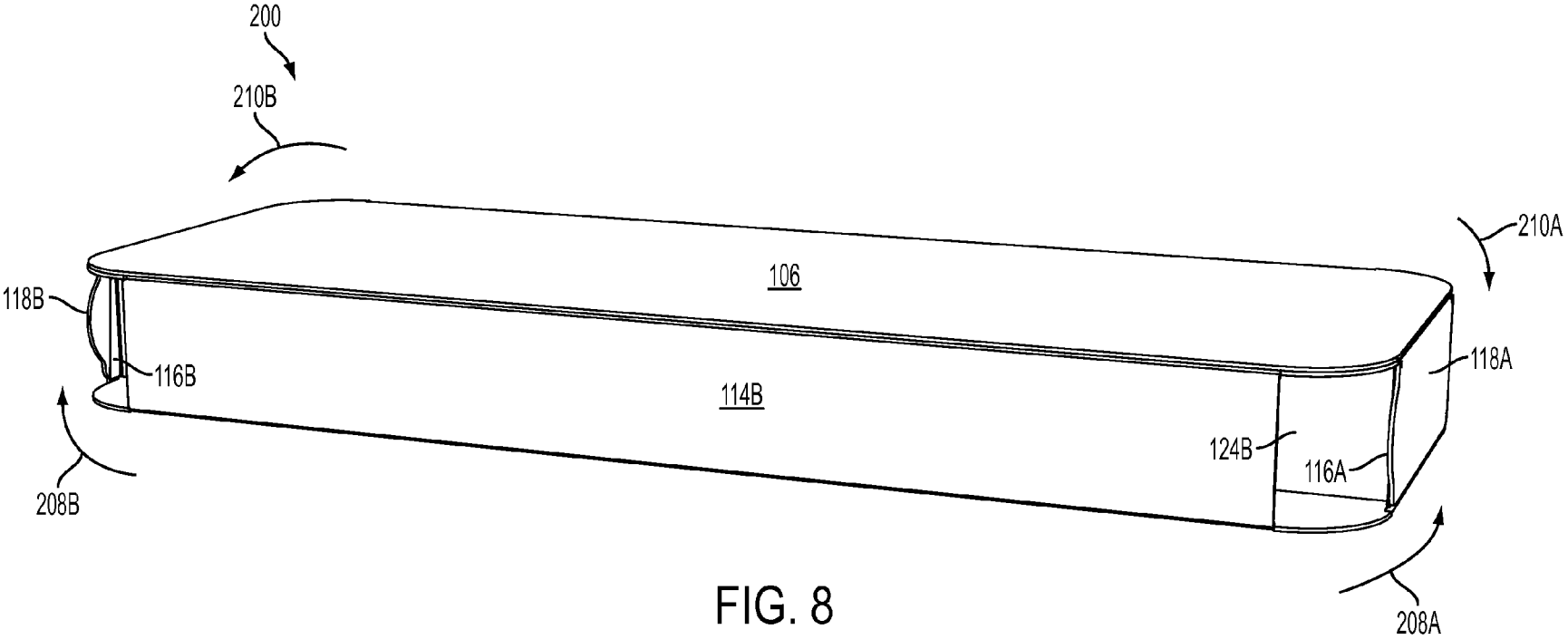
FIG. 8 is a perspective view of the package of FIG. 7 with the cover panel of the package in a closed configuration and end panels closed according to an example embodiment of the present disclosure.

As illustrated in FIG. 8, one of the final steps in formation of the package 200 may include folding the first end panels 116 relative to the bottom panel 108. More particularly, the first end panels 116 may be folded substantially upwardly, in terms of the orientation illustrated in FIG. 8, as indicated by arrows 208A, B. Further, the second end panels 118 may be folded downwardly, in terms of the orientation illustrated in FIG. 8, as indicated by arrows 210A, B.

The first end panels 116 may be coupled to the second end panels 118 during the folding movement illustrated in FIG. 8 via an adhesive as described above or other bonding mechanism such as via a heat weld. As illustrated in FIG. 1, an adhesive may be placed on the first side 102 of the blank 100 at an adhesive area 156A, B on the first end panels 116. Alternatively or additionally, as illustrated in FIG. 2, an adhesive may be placed on the second side 104 of the blank 100 at an adhesive area 158A, B on the second end panels 118. Accordingly, the first end panels 116 and the second end panels 118 may be coupled together in order to retain one or more products in the main compartment 204 of the package 200.

Thus, as illustrated in FIG. 8, the package 200 may define a substantially enclosed configuration. More particularly, FIG. 8 illustrates the package 200 with the cover panel 106 in a closed configuration in which the apertures 120 in the top panel 110 are covered by the cover panel and the cover panel is secured to the top panel. This configuration may, for example, be employed during shipment of the package 200.

Figure 9:
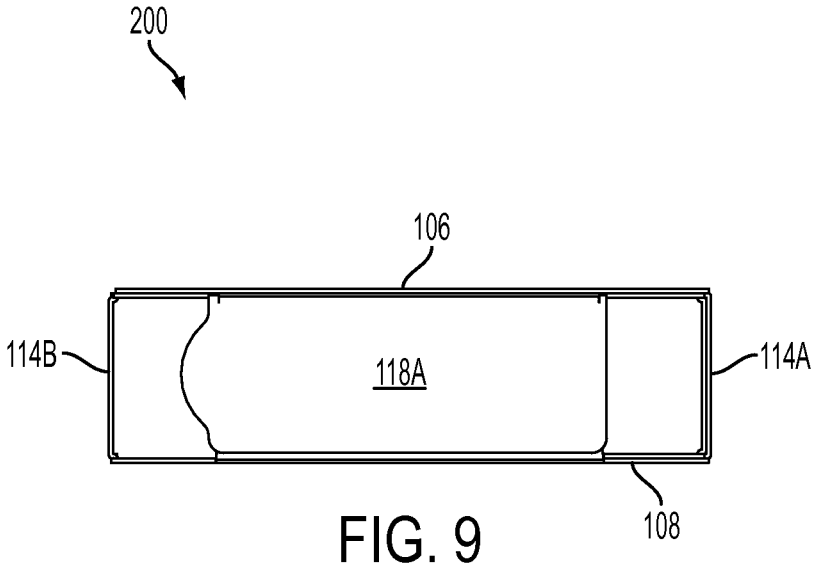
FIG. 9 is a right side view of the package in the configuration illustrated in FIG. 8.
Figure 10:
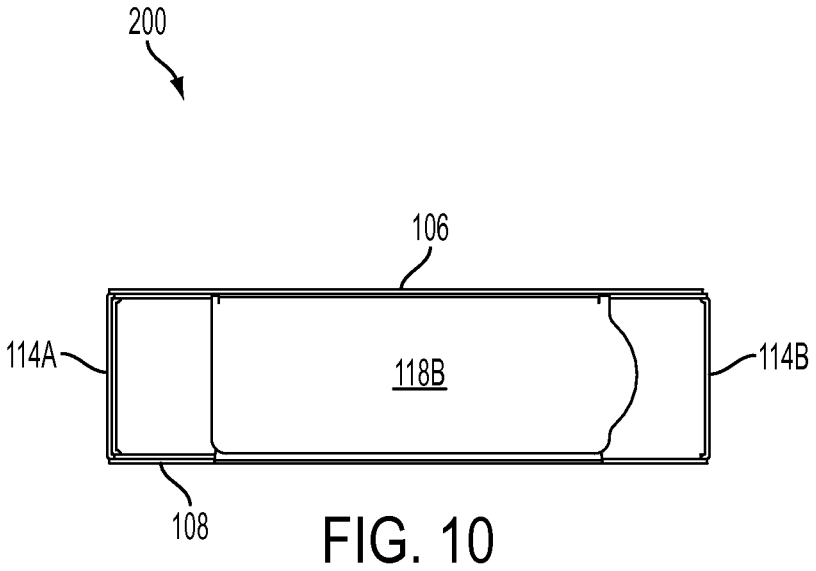
FIG. 10 is a left side view of the package in the configuration illustrated in FIG. 8.
Figure 11:
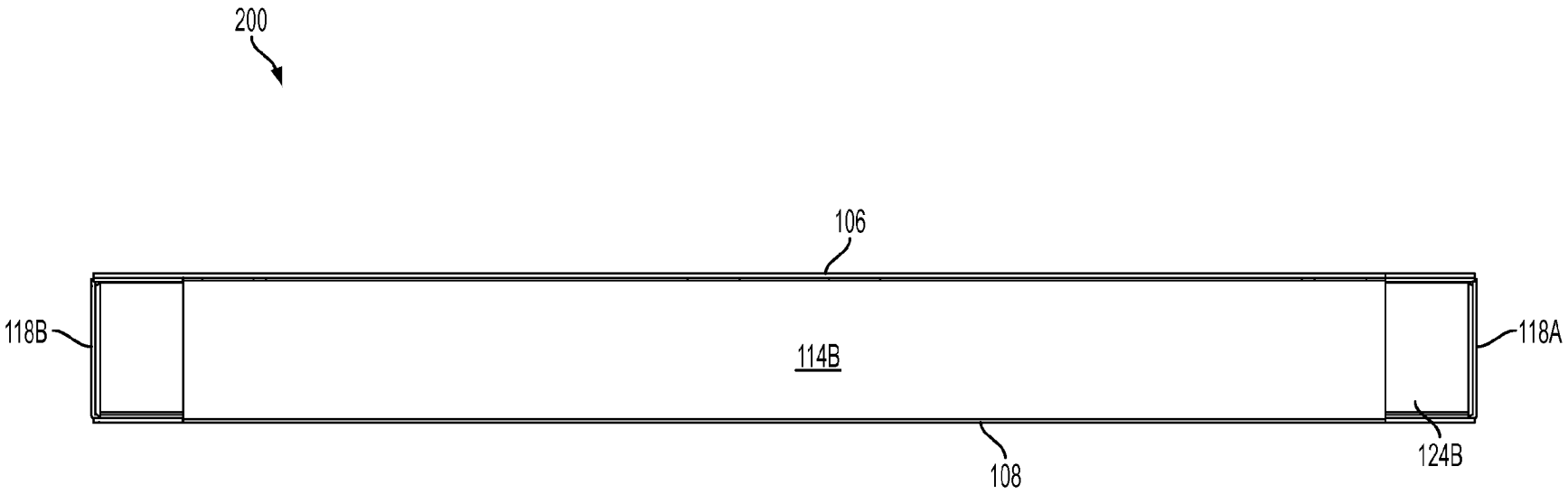
FIG. 11 is a front view of the package in the configuration illustrated in FIG. 8.
Figure 12:
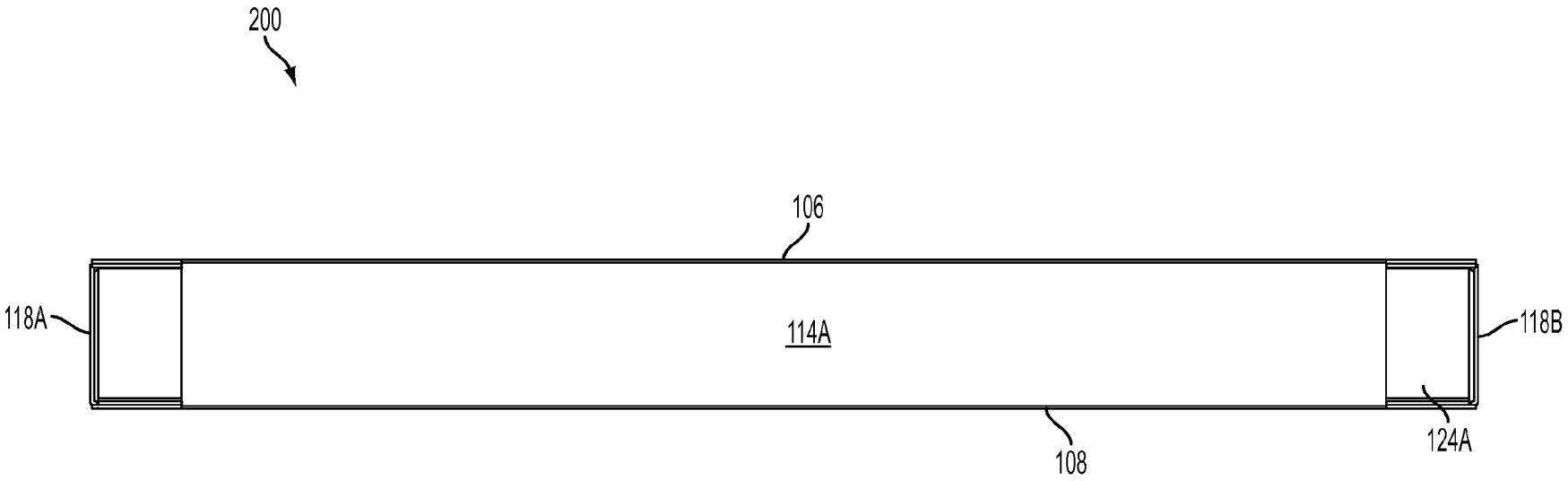
FIG. 12 is a rear view of the package in the configuration illustrated in FIG. 8.
Figure 13:
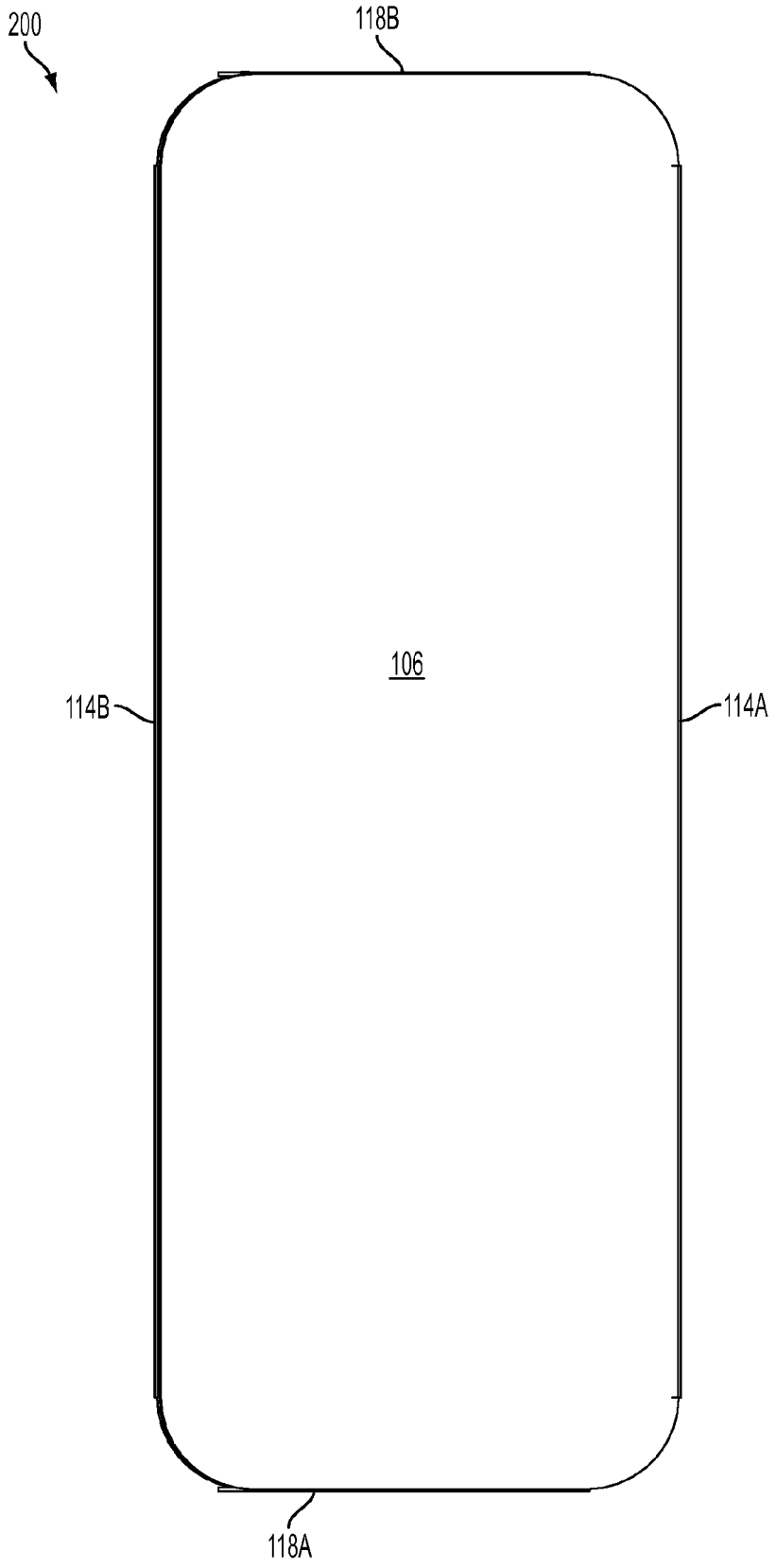
FIG. 13 is a top view of the package in the configuration illustrated in FIG. 8.
Figure 14:
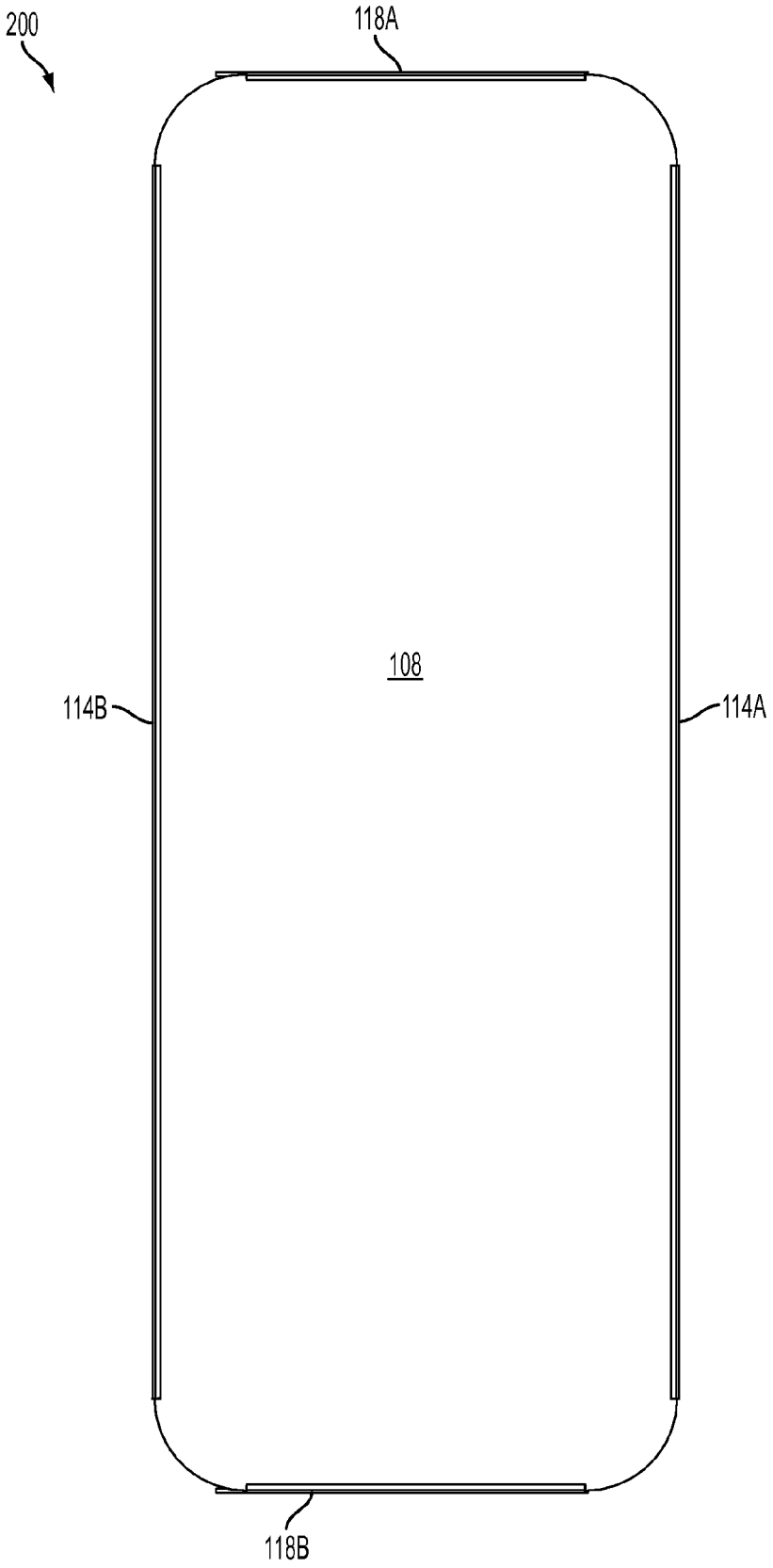
FIG. 14 is a bottom view of the package in the configuration illustrated in FIG. 8.

FIGS. 9-14 illustrate alternate perspective views of the package with the cover panel 106 in the closed configuration and the end panels 116, 118 coupled to one another. More particularly, FIG. 9 illustrates a right side view of the package 200. FIG. 10 illustrates a left side view of the package 200. FIG. 11 illustrates a front view of the package 200. FIG. 12 illustrates a rear view of the package 200. FIG. 13 illustrates a top view of the package 200. FIG. 14 illustrates a bottom view of the package 200.

Figure 15:
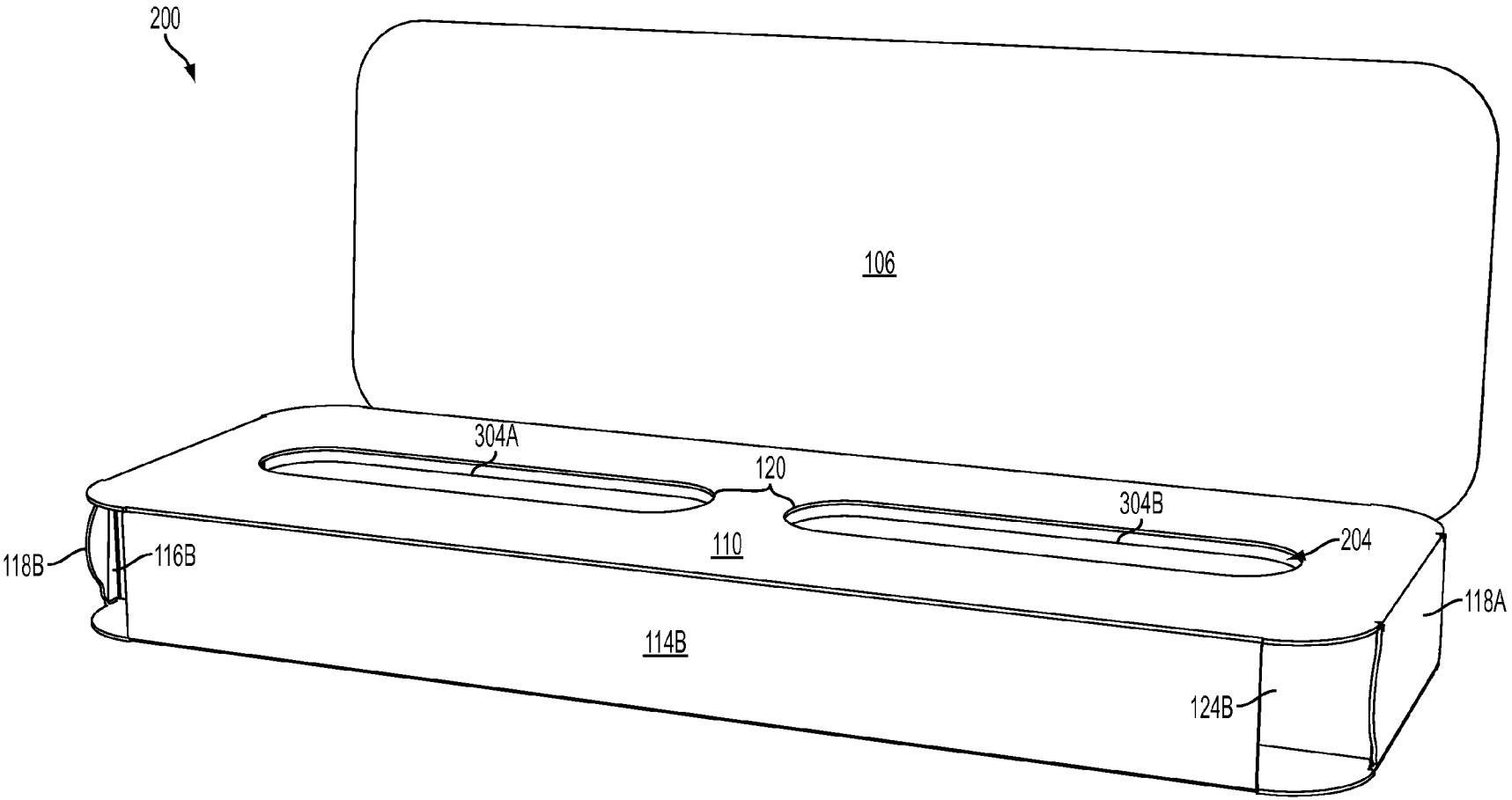
FIG. 15 is a perspective view of the package of FIG. 7 with the cover panel in an open configuration and the end panels closed according to an example embodiment of the present disclosure.

FIG. 15 illustrates a perspective view of the package 200 with the cover panel 106 in an open configuration and the end panels 116, 118 coupled to one another. This configuration may correspond to a display configuration. In this regard, when the cover panel 106 is in the open configuration the apertures 120 in the top panel 110 may be visible. Accordingly, a user may look through the apertures 120 in the top panel 110 and the aligning apertures 122 in the elevating panel 112 to view the contents of the package 200. Thus, by way of example, a user may inspect the contents of the package 200 determine if the consumer want to purchase the package or determine how many units of product therein remain. For example, in the illustrated embodiment the product 300 includes first and second cartridges 306A, B received in first and second bubbles 304A, B.

Figure 16:
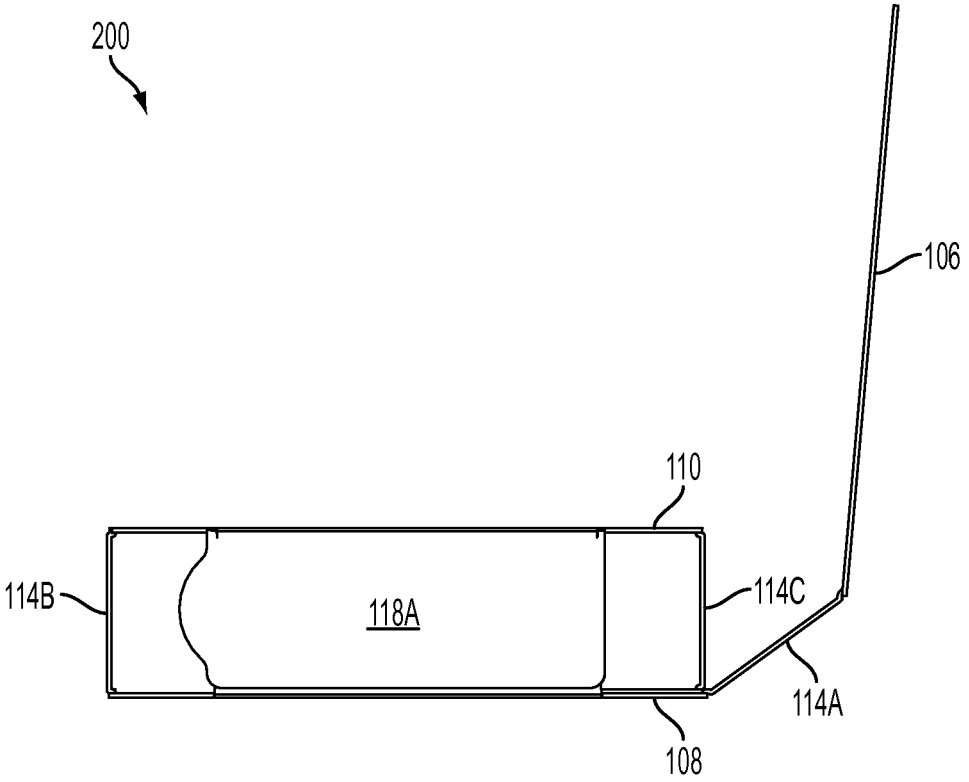
FIG. 16 is a right side perspective view of the package in the configuration illustrated in FIG. 15.
Figure 17:
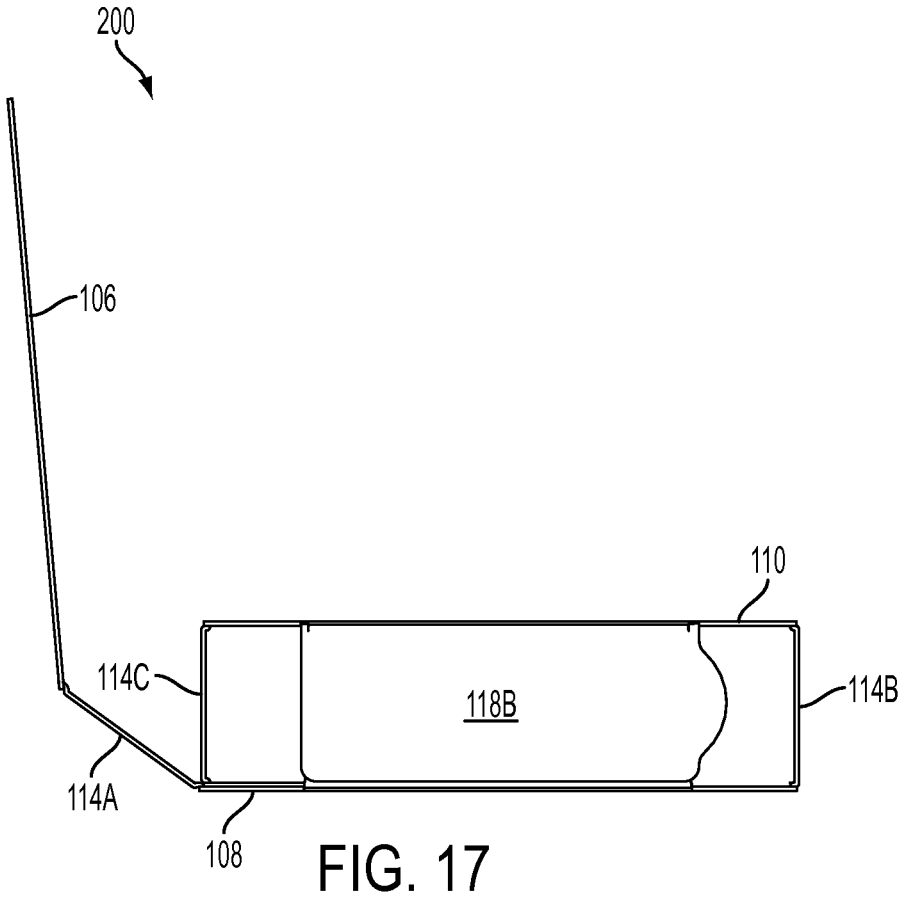
FIG. 17 is a left side perspective view of the package in the configuration illustrated in FIG. 15.
Figure 18:
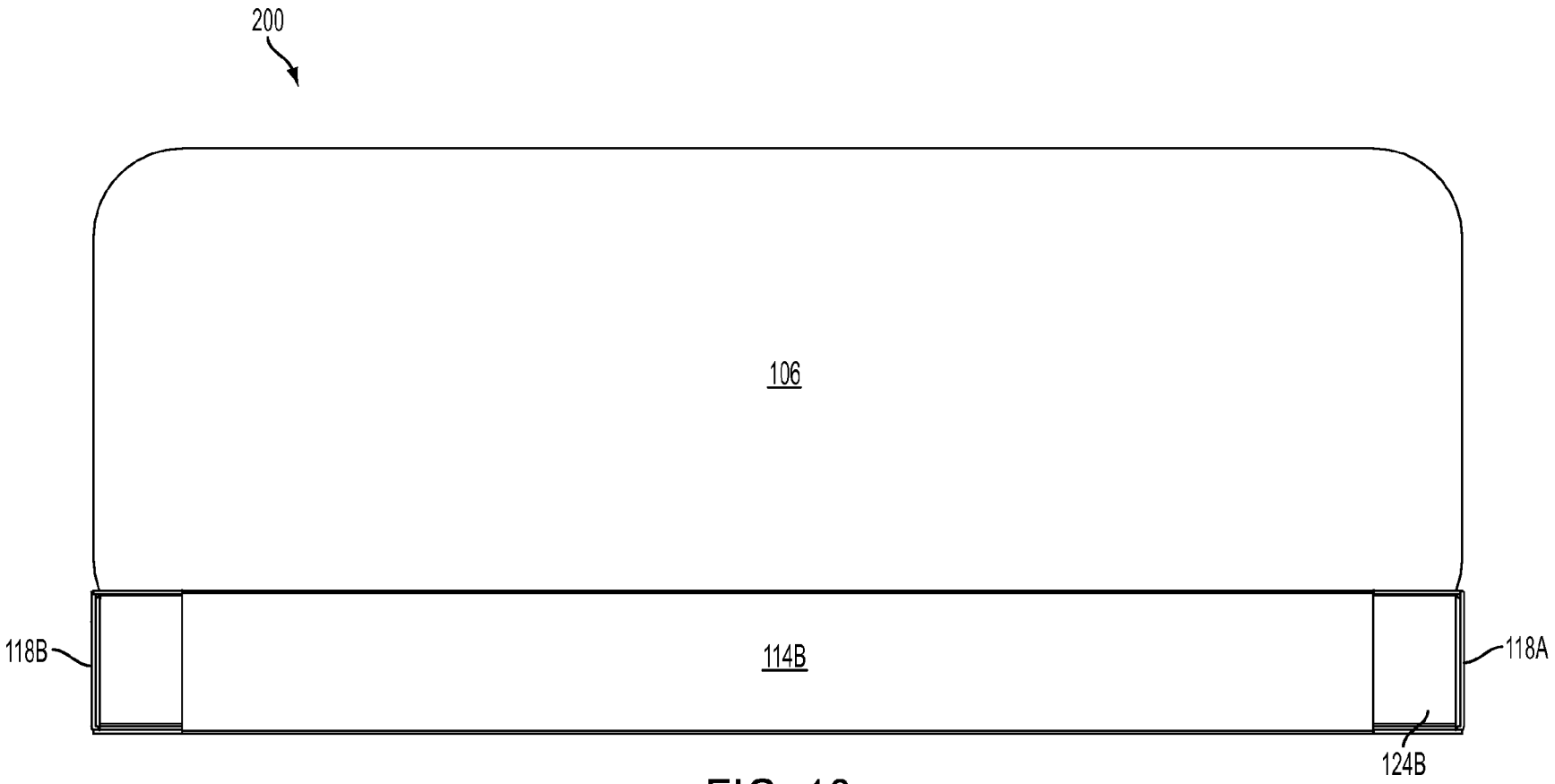
FIG. 18 is a front view of the package in the configuration illustrated in FIG. 15.
Figure 19:
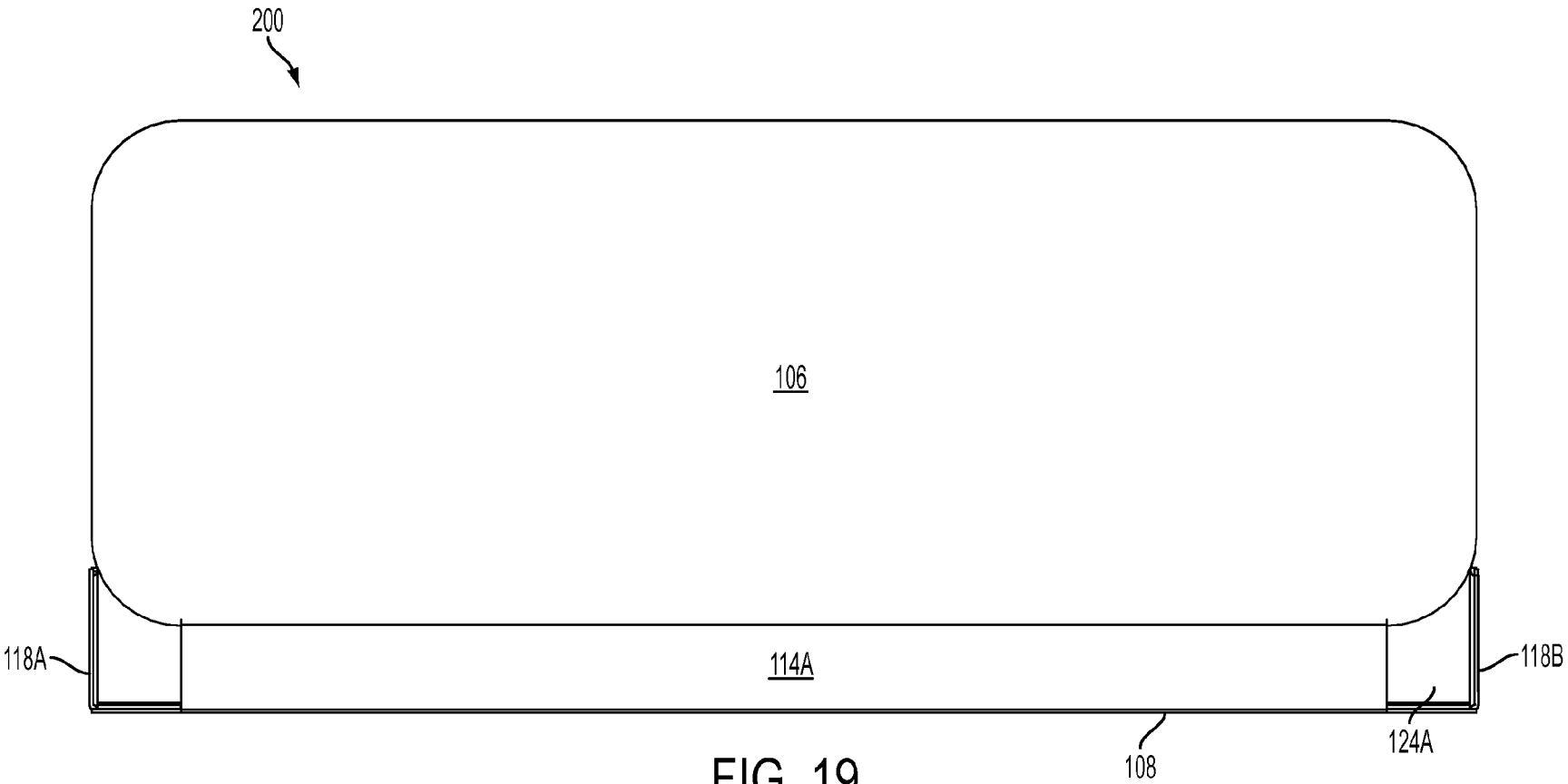
FIG. 19 is a rear view of the package in the configuration illustrated in FIG. 15.
Figure 20:
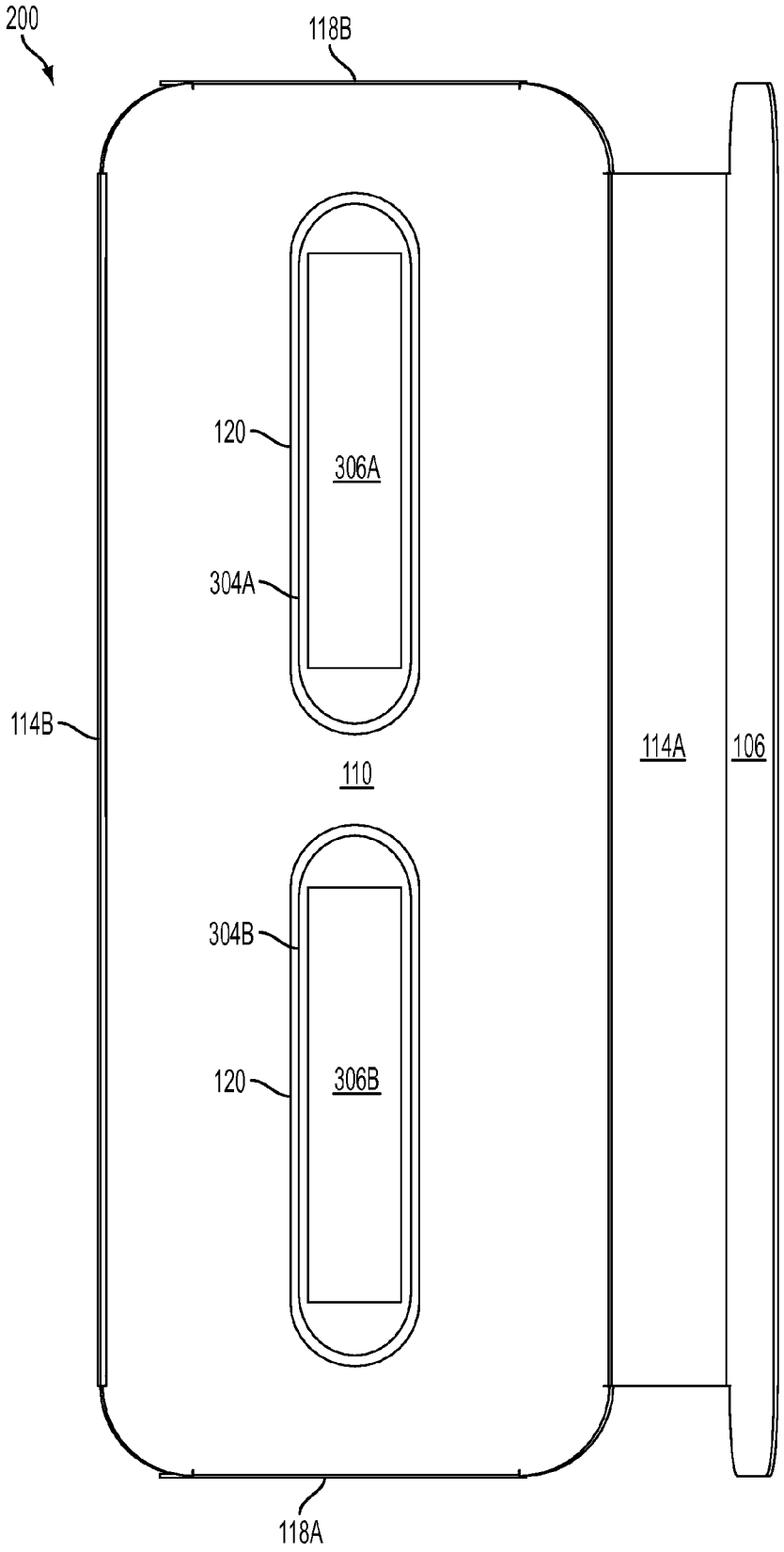
FIG. 20 is a top view of the package in the configuration illustrated in FIG. 15.
Figure 21:
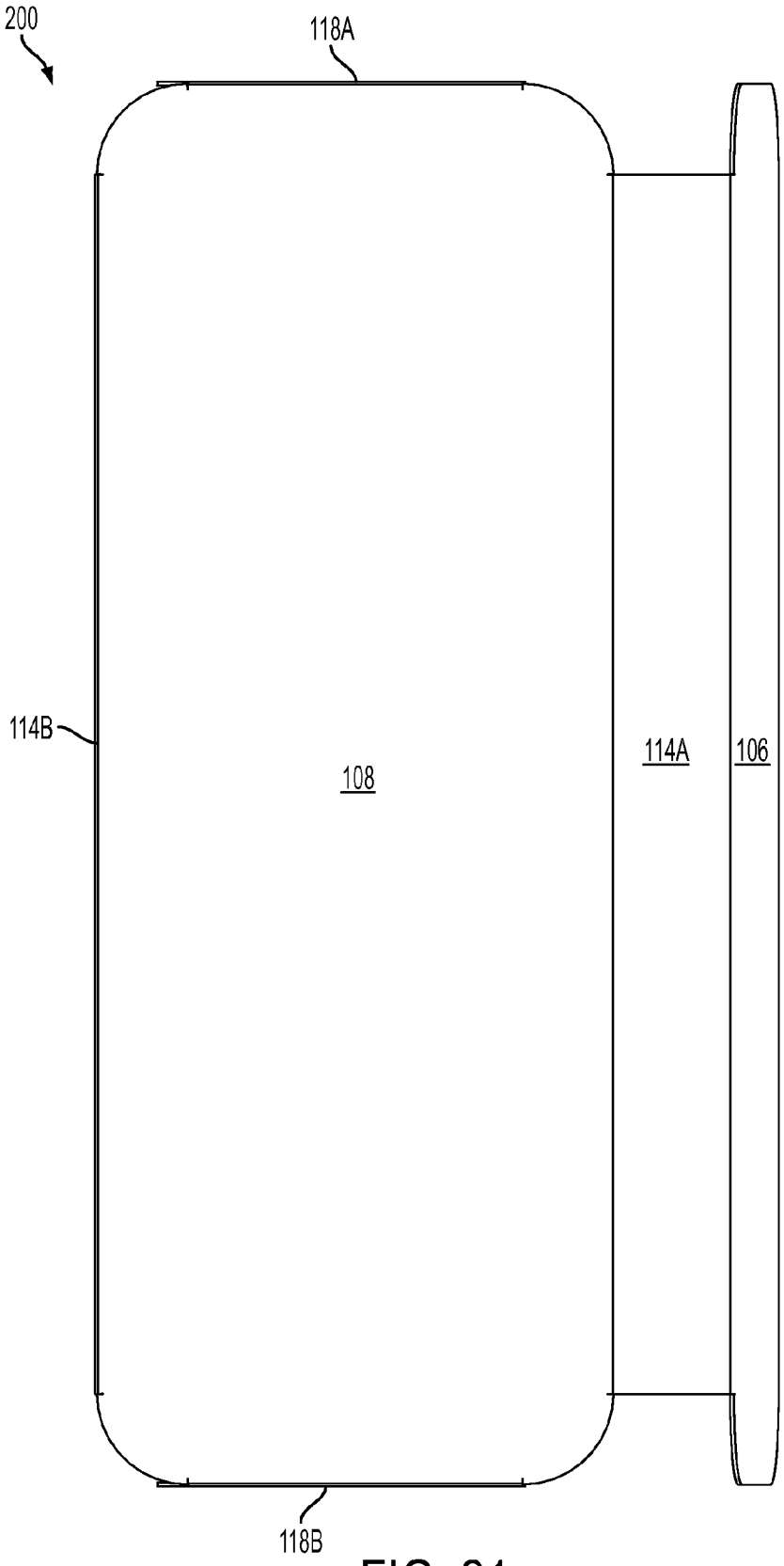
FIG. 21 is a bottom view of the package in the configuration illustrated in FIG. 15.

FIGS. 16-21 illustrate alternate perspective views of the package with the cover panel 106 in the open configuration and the end panels 116, 118 coupled to one another. More particularly, FIG. 16 illustrates a right side view of the package 200. FIG. 17 illustrates a left side view of the package 200. FIG. 18 illustrates a front view of the package 200. FIG. 19 illustrates a rear view of the package 200. FIG. 20 illustrates a top view of the package 200. FIG. 21 illustrates a bottom view of the package 200.

In one example embodiment, the package 200 may define a height of about 5 to about 15 mm (e.g., about 10 mm), a width of about 100 to about 120 mm (e.g., about 110 mm) and a depth of about 30 to about 50 mm (e.g., about 40 mm). However, various other sizes of the package may be employed depending on the product stored therein. By way of example, when a product stored therein includes a greater number of cartridges, the package may define larger dimensions, whereas in an embodiment in which the product includes a fewer number of cartridges, the package may define smaller dimensions.

Although directional terms such as top, bottom, front, back, etc. have been employed herein, it should be understood that these terms have been provided for explanatory purposes only. In this regard, the blank and package disclosed herein may be employed in other configurations and orientations beyond those described above.

Many modifications and other embodiments of the disclosure will come to mind to one skilled in the art to which this disclosure pertains having the benefit of the teachings presented in the foregoing description; and it will be apparent to those skilled in the art that variations and modifications of the present disclosure can be made without departing from the scope or spirit of the disclosure. Therefore, it is to be understood that the disclosure is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A blank configured to form a package, the blank comprising:

a cover panel;

a bottom panel coupled to the cover panel;

a top panel coupled to the bottom panel, the top panel comprising one or more apertures; and an elevating panel coupled to the top panel, the elevating panel comprising:

a first side panel;

a second side panel; and a center panel positioned between the first side panel and the second side panel and defining one or more aligning apertures extending therethrough and configured to overlap and align with the one or more apertures of the top panel when the center panel is folded in contact with, and substantially parallel to, the top panel.

2. The blank of claim 1, further comprising a plurality of connecting panels, wherein a respective one of the connecting panels is positioned between the cover panel and the bottom panel, between the bottom panel and the top panel, and between the top panel and the elevating panel.

3. The blank of claim 1, further comprising:

a first plurality of end panels coupled to the bottom panel; and a second plurality of end panels coupled to the top panel, wherein the first plurality of end panels are configured to overlap with the second plurality of end panels.

4. The blank of claim 1, wherein the elevating panel further comprises a first engagement panel and a second engagement panel, wherein the first side panel is positioned between the first engagement panel and the one or more aligning apertures and the second side panel is positioned between the second engagement panel and the one or more aligning apertures.

5. A package, comprising:

a cover panel;

a bottom panel coupled to the cover panel;

a top panel coupled to the bottom panel, the top panel comprising one or more apertures; and an elevating panel coupled to the top panel, the elevating panel comprising:

a first side panel;

a second side panel; and a center panel positioned between the first side panel and the second side panel and defining one or more aligning apertures extending therethrough, the first side panel and the second side panel extending between the bottom panel and the top panel and positioning the center panel in contact with, and substantially parallel to, the top panel such that the one or more aligning apertures of the elevating panel overlap and align with the one or more apertures of the top panel and a compartment is defined by the elevating panel and the bottom panel.

6. The package of claim 5, further comprising a plurality of connecting panels, wherein a respective one of the connecting panels is positioned between the cover panel and the bottom panel, between the bottom panel and the top panel, and between the top panel and the elevating panel.

7. The package of claim 5, further comprising:

a first plurality of end panels coupled to the bottom panel; and a second plurality of end panels coupled to the top panel, wherein the first plurality of end panels overlap with the second plurality of end panels.

8. The package of claim 5, further comprising an attachment mechanism coupled to one or both of the cover panel and the top panel and configured to releasably couple the cover panel to the top panel.

9. The package of claim 5, wherein the elevating panel further comprises a first engagement panel and a second engagement panel respectively engaged with the bottom panel, wherein the first side panel is positioned between the first engagement panel and the one or more aligning apertures and the second side panel is positioned between the second engagement panel and the one or more aligning apertures.

10. The package of claim 5, wherein the cover is hingedly coupled to the bottom panel and configured to move between a closed configuration in which the cover covers the one or more apertures of the top panel and an open configuration in which the one or more apertures of the top panel are uncovered.

11. A method for forming a package, the method comprising:

providing a blank defining a first side and a second side, the blank comprising:

a cover panel;

a bottom panel coupled to the cover panel;

a top panel coupled to the bottom panel, the top panel comprising one or more apertures; and an elevating panel coupled to the top panel, the elevating panel comprising:

a first side panel;

a second side panel; and a center panel positioned between the first side panel and the second side panel and defining one or more aligning apertures extending therethrough;

coupling the elevating panel to the bottom panel; and positioning the center panel in contact with, and substantially parallel to, the top panel such that the one or more aligning apertures of the elevating panel overlap and align with the one or more apertures of the top panel and a compartment is defined by the elevating panel and the bottom panel.

12. The method of claim 11, wherein the elevating panel further comprises a first engagement panel and a second engagement panel, wherein the first side panel is positioned between the first engagement panel and the one or more aligning apertures and the second side panel is positioned between the second engagement panel and the one or more aligning apertures, and wherein coupling the elevating panel to the bottom panel comprises coupling the first engagement panel and the second engagement panel to the bottom panel.

13. The method of claim 11, further comprising:

folding the blank between the second side panel and the center panel toward the first side;

folding the blank between the elevating panel and the top panel toward the second side; and folding the blank between the top panel and the bottom panel toward the second side.

14. The method of claim 13, further comprising coupling an attachment mechanism to one or both of the cover panel and the top panel and folding the blank between the bottom panel and the cover panel toward the second side.

15. The method of claim 11, wherein the blank further comprises a first plurality of end panels coupled to the bottom panel and a second plurality of end panels coupled to the top panel, the method further comprising folding the first plurality of end panels relative to the bottom panel toward the second side, folding the second plurality of end panels relative to the top panel toward the second side, and coupling the first plurality of end panels to the second plurality of end panels.

* * * * *